United States Patent [19]

Kawasaki

[11] Patent Number: 4,707,950

[45] Date of Patent: Nov. 24, 1987

[54] RING GRINDING TOOL

[75] Inventor: Katsuhiro Kawasaki, Uji, Japan

[73] Assignee: Toho Yogyo Kabushiki Kaisha, Shiga, Japan

[21] Appl. No.: 936,385

[22] Filed: Dec. 1, 1986

Related U.S. Application Data

[63] Continuation-in-part of Ser. No. 854,717, Apr. 16, 1986, abandoned, which is a continuation of Ser. No. 561,398, Dec. 14, 1983, abandoned.

[51] Int. Cl.[4] ..... B24D 11/00

[52] U.S. Cl. ..... 51/401; 51/206 P; 51/357; 51/358

[58] Field of Search ..... 51/136, 206 R, 206 NF, 51/206 P, 206.4, 206.5, 207, 358, 381, 394, 395, 397, 401, 407, 402, 297, 299, 357

[56] References Cited

U.S. PATENT DOCUMENTS

| | | | |
|---|---|---|---|
| 1,515,210 | 11/1924 | Kalteyer | 51/206 R |
| 1,975,070 | 10/1934 | Benner et al. | 51/207 |
| 2,001,911 | 5/1935 | Wooddell et al. | 51/299 X |
| 2,024,591 | 12/1935 | Manchester | 51/206 R |
| 2,421,886 | 6/1947 | Howe et al. | 51/206.4 |
| 2,730,439 | 1/1956 | Houchins | 51/206 NF X |
| 3,498,010 | 3/1970 | Hagihara | 51/395 |
| 3,623,275 | 11/1971 | Koella | 51/206 P |
| 4,114,322 | 9/1978 | Greenspan | 51/206 R |

FOREIGN PATENT DOCUMENTS

| | | | |
|---|---|---|---|
| 565929 | 8/1957 | Italy | 51/206 R |
| 46-36390 | 12/1971 | Japan . | |

*Primary Examiner*—Robert P. Olszewski

*Attorney, Agent, or Firm*—Wegner & Bretschneider

[57] ABSTRACT

A ring grinding tool suitable for use in grinding or polishing a workpiece, particularly having a curvature, is provided. The tool comprises at least one rubber-made supporting layer reinforced with a metal wire and having a surface adapted for mating and contacting a rotary wheel, at least one porous elastic layer provided on the supporting layer, at least one elastic protective layer made of a rubber sheet provided on the porous elastic layer and a plurality of flat abrasive pieces provided on the elastic protective layer.

3 Claims, 5 Drawing Figures

RING GRINDING TOOL

REFERENCE TO RELATED APPLICATIONS

This application is a continuation-in-part of U.S. application Ser. No. 854,717 filed Apr. 16, 1986, which is a continuation of U.S. application Ser. No. 561,398 filed Dec. 14, 1983, now both abandoned. The disclosures of the parent application are incorporated herein by reference.

BACKGROUND OF THE INVENTION

1. Field of the Invention

This invention relates to a ring grinding tool having excellent conformance to the workpiece to be ground.

2. Description of the Prior Art

Hitherto it has been difficult or rather impossible to grind the surface of a workpiece having a curvature in such a manner that a grinding tool can be fitted to said surface without any change of said curvature. In other words, the production of incontinuous surfaces on the surface of a workpiece when ground cannot be avoided in the prior art. Particularly when a workpiece having a small curvature is to be ground, it cannot be uniformly ground. In order to overcome this defect, the inventor previously devised a ring buffing wheel as described in Japanese Utility Model KOKOKU (Post-Exam. Publn.) No. 36390/71. This buffing wheel comprises a rotary wheel having a highly elastic supporting layer on the peripheral surface thereof and a buffing ring having a plurality of flat abrasive pieces adhered onto the peripheral surface thereof, and said buffing ring is removable. However, this buffing wheel also cannot afford any satisfactory grinding or polishing finish. In detail, the buffing ring of the Japanese Utility Model comprises a multilayered laminate of a rubber sheet and a fabric formed of fibers such as glass fibers, having a high tensile strength and low elongation. On said laminate there are placed abrasive pieces with an adhesive. This buffing ring serves as a protector from the centrifugal destruction of said elastic supporting layer due to the high-speed rotation of the rotary wheel, but this buffing wheel has no excellent conformance to a workpiece to be ground since said abrasive pieces do not receive the elasticity of said highly elastic supporting layer.

SUMMARY OF THE INVENTION

The object of this invention is to provide a ring grinding tool having excellent conformance to a work-piece to be ground.

In accordance with this invention, there is provided a ring grinding tool suitable for use in grinding or polishing a workpiece, particularly one having a curvature, which comprises at least one rubber-made supporting layer reinforced with a metal wire(s) and having a surface adapted for mating and contacting a rotary wheel, at least one porous elastic layer provided on said supporting layer, at least one elastic protective layer made of a rubber sheet provided on said porous elastic layer and a plurality of flat abrasive pieces provided on said elastic protective layer.

DETAILED DESCRIPTION OF PREFERRED EMBODIMENTS

This invention will be illustrated below with reference to the drawings attached.

Figure 1:
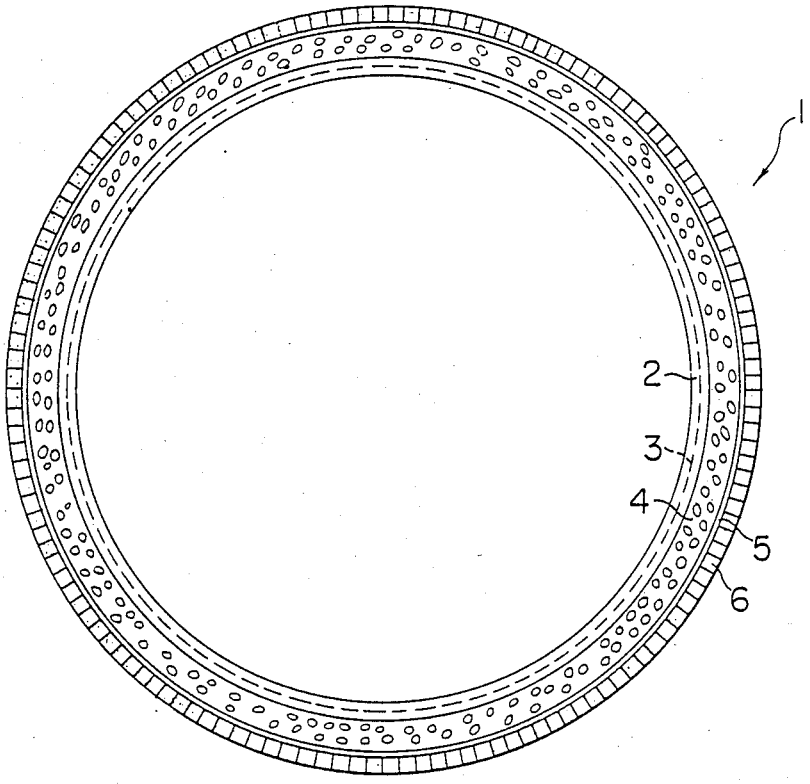
FIG. 1 is a cross-sectional profile view of the ring grinding tool according to this invention.
Figure 4:
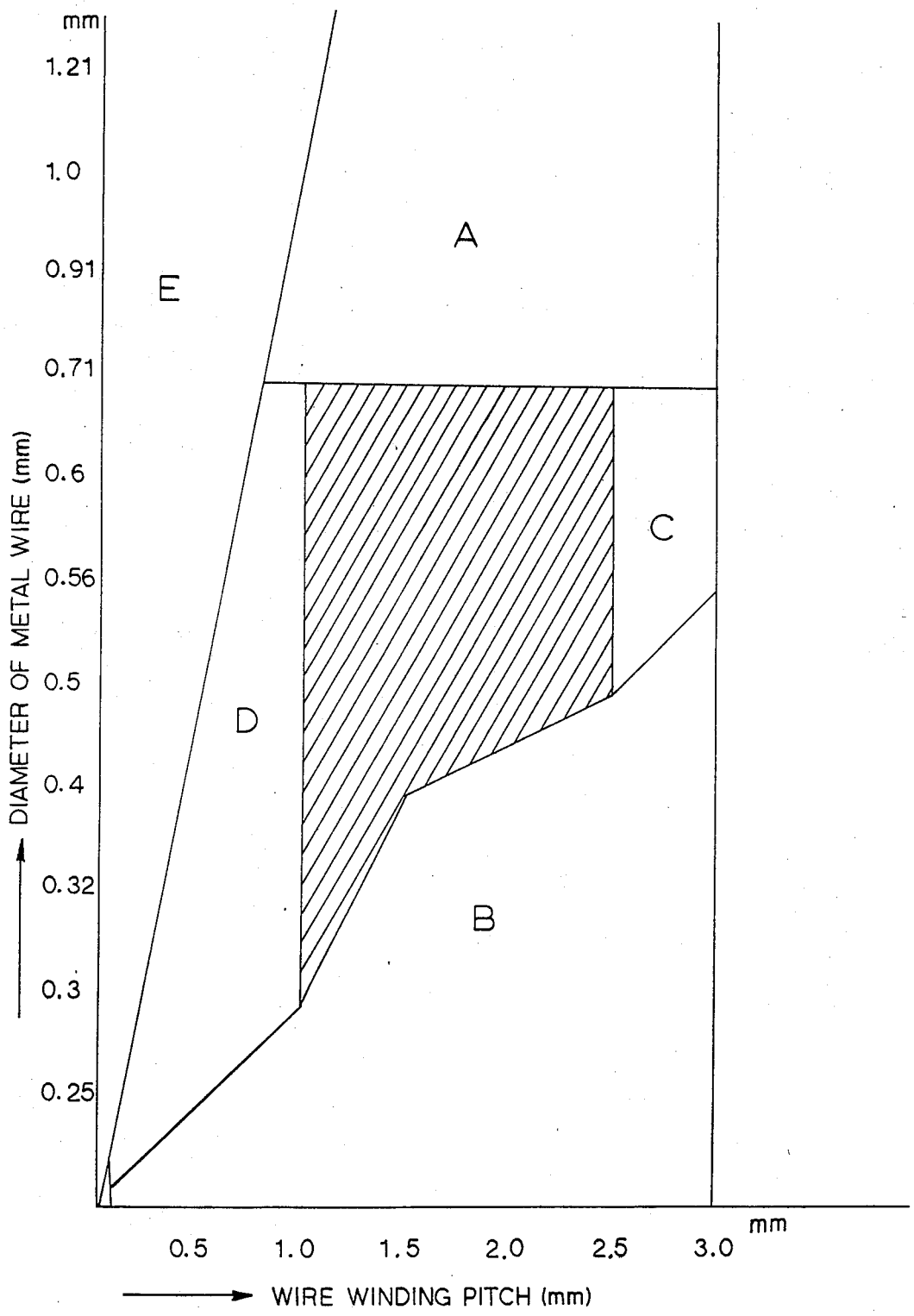
FIG. 4 shows a graph which illustrates the effect of the diameter and coil pitch of the reinforcing metal wire in the supporting means of the ring grinding tool.

In FIG. 1, 2 is a means for supporting the whole of the ring grinding tool 1. Supporting means 2 is formed from a rubber sheet, particularly a soft rubber sheet containing a metal wire(s) 3 such as music wire incorporated therein at the center of said sheet. The music wire or metal wire preferably has a diameter of 0.3 to 0.71 mm. It is preferably wound or coiled such that the pitch or distance between each turn of the coil is 1.0 to 2.5 mm. FIG. 4 illustrates a graph of the diameter and pitch of metal wire 3. The hatched region represents the preferred diameters and pitches of metal wire 3. If the pitch or diameter of the metal wire falls outside of the hatched area in FIG. 4, supporting means 2 does not perform as well in the ring grinding tool. The area of FIG. 4 designated A represents the range of metal wire diameters and coil pitches that will render supporting means 2 insufficiently elastic. In area B, supporting means 2 is lacks sufficient tensile strength. In area C, the sides of supporting means 2 are easily deformed during use of the ring grinding tool. In area D, the quality of supporting means 2 is unstable. In area E, it is impossible to make supporting means 2.

It has been found that if metal wire 3 is plated with zinc bronze, the adhesion of metal wire 3 to supporting means 2 is enhanced. Table 1 shows measurements of the adhesive strength of the metal wire to the supporting means under ASTAM D-1871 using a ½" mold. The adhesive strength of the metal wire to the rubber of the supporting layer is empirically required to be at least one tenth of the tensile strength of the wire itself. Table 1 shows that the zinc bronze plated metal wire adheres more tenaciously to supporting means 2 than unplated metal wire or metal wire plated with copper, zinc, nickel, chromium, or stainless steel.

TABLE 1

| | Plating | | | | | | | | | | | | |
|---|---|---|---|---|---|---|---|---|---|---|---|---|---|
| | — | Zn—Cu | — | Zn—Cu | Cu | Zn | Ni | Cr | Stainless steel | — | Zn—Cu | — | Zn—Cu |
| | Diameter | | | | | | | | | | | | |
| Run | 0.3 mm | | | | 0.56 mm | | | | | 0.71 mm | | 0.91 mm | |
| 1 | 0 | 12.5 | 1 | 22.5 | 4.5 | 6 | 1 | 1 | 2 | 1 | 32 | 2 | 40 |
| 2 | 0 | 13.5 | 1 | 25.5 | 5 | 5.5 | 1 | 0.5 | 1 | 1.5 | 34.5 | 1 | 42 |
| 3 | 0.5 | 12 | 1 | 24 | 5 | 5 | 1.5 | 1.5 | 1 | 1 | 32.5 | 2 | 44.5 |
| 4 | 0 | 10.5 | 0.5 | 24 | 4.5 | 7 | 1.5 | 1 | 2.5 | 1 | 33 | 1.5 | 40 |

TABLE 1-continued

| | Plating | | | | | | | | | | | | |
|---|---|---|---|---|---|---|---|---|---|---|---|---|---|
| | — | Zn—Cu | — | Zn—Cu | Cu | Zn | Ni | Cr | Stainless steel | — | Zn—Cu | — | Zn—Cu |
| | Diameter | | | | | | | | | | | | |
| Run | 0.3 mm | | | | 0.56 mm | | | | | 0.71 mm | | 0.91 mm | |
| 5 | 0 | 11.5 | 0.5 | 26.5 | 6 | 6 | 0.5 | 1 | 1.5 | 1.5 | 33 | 1.5 | 42 |
| 6 | 0 | 12 | 1 | 25 | 4 | 7.5 | 1 | 1.5 | 1 | 1.5 | 31 | 2 | 41.5 |
| 7 | 0 | 12.5 | 1 | 24.5 | 6 | 5 | 2 | 2 | 1 | 1 | 32 | 1.5 | 41 |
| 8 | 0 | 12 | 1 | 24 | 4 | 7.5 | 1 | 1 | 2 | 1 | 34 | 2 | 42 |
| 9 | 0.5 | 11.5 | 1 | 25 | 5.5 | 5.5 | 1 | 1 | 1.5 | 1 | 29.5 | 1.0 | 38 |
| 10 | 0 | 13 | 1 | 24.5 | 3.5 | 5 | 0.5 | 1.5 | 2.5 | 1.5 | 32.5 | 1.5 | 40 |
| $\bar{x}$ | ca. 0 | 12.1 | 0.9 | 24.6 | 4.8 | 6.0 | 1.1 | 1.2 | 1.6 | 1.2 | 32.4 | 1.6 | 41.1 |
| A | 1.7 | | | | 5.8 | | | | | 9.3 | | 15.3 | |

A: Empirically needed adhesive strength (kg)

Supporting means 2 preferably has a thickness of 2 to 4 mm. This thickness range is most effective for obtaining a grinding tool that has good conformance to a workpiece to be ground or polished.

On the supporting means 2 there is placed at least one elastic layer 4. As a material of said elastic layer 4 is most preferably used an elastic, porous synthetic resin. Suitable materials are natural rubber or styrene-butadiene rubber. Preferably, elastic layer 4 has a thickness of 8 to 10 mm.

On said elastic layer 4 there is adhered at least one elastic protective layer made of a rubber sheet 5 for protecting said elastic layer 4 and firmly fixing abrasive pieces 6 on the protective layer 5. Protective layer 5 is suitably made of natural rubber or styrene-butadiene rubber and has a thickness of 0.8 to 1.0 mm.

Figure 2:
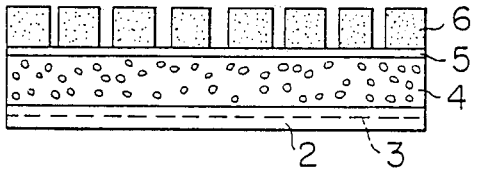
FIG. 2 is a partial scaled-up cross-sectional view of the ring grinding tool according to this invention.

Abrasive pieces 6, as shown in FIG. 2 depicting the scaled-up cross-sectional view of part of the ring grinding tool, are arranged with interstices between the pieces on the protective layer 5. It has been found that the use of the protective layer 5 can prevent the elastic layer 4 (corresponding to the highly elastic supporting layer of said Japanese Utility Model KOKOKU) from being destroyed by high-speed rotation. Furthermore, the protective layer 5 can convey the elastic force of said elastic layer 4 directly to the abrasive pieces 6 and, therefore, said pieces move independently from one another so as to fit the curved surfaces of a workpiece being ground, and thus the ring grinding tool of this invention is highly conformed to a workpiece to be ground.

The ring grinding tool according to this invention may be used in such a way that it is put on a rotary wheel (not shown) which has hitherto been used. For example, the rotary wheel disclosed in said Japanese Utility Model KOKOKU is preferably used, but this ring grinding tool also may be used as a grinding belt.

The sizes of the whole and parts of the ring grinding tool according to this invention may vary depending upon the sizes of workpieces to be ground and/or kinds of materials from which the workpieces are made.

This invention will be explained below with reference to some examples.

EXAMPLES

Grinding Tool Used:

(1) TRB (the ring buffing wheel of said Japanese Utility Model KOKOKU No. 36390/71).

(2) The tool of this invention (put on a rotary wheel). The size of both the tools was 308×50×4 mm. The abrasive used was WA abrasive grains. The thickness of the elastic layer in tool (2) was 10 mm.

Ground Workpieces:

Cylindrical products formed of mild steel Size of the Ground Workpieces:

| | |
|---|---|
| (a) | 250 mm (length) × 15 mm (radius) |
| (b) | 250 mm (length) × 12 mm (radius) |
| (c) | 250 mm (length) × 50 mm (radius) |

Peripheral Speed: 1700 m/min.

Grinding Pressure: 1.5 to 2.0 kg

The outer surface of each of the cylindrical workpieces was longitudinally ground under the above-mentioned conditions while moving the grinding tool, and the change of the ground workpiece in curvature radius was measured in the following manner. Firstly, before grinding, the roundness of the workpiece to be ground was measured by a dial gauge in a usual manner and then, after grinding, the width and maximum ground reduction of the ground surface were measured. The change in curvature radius of the ground surface was calculated from the measured values. Then a rate of change in curvature radius was obtained by the following equation:

$$\text{Rate of Change in Curvature Radius} = \frac{\text{Curvature Radius After Grinding} - \text{Original Curvature Radius}}{\text{Original Curvature Radius}} \times 100$$

The measured values and the results of the calculation are reported in TABLE 2.

Figure 3A:
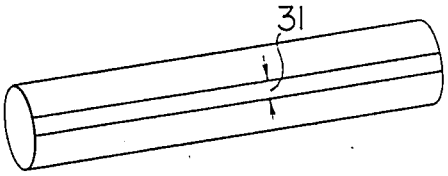
FIG. 3*a* is a pictorial view of a workpiece ground and FIG. 3*b* a radially cross-sectional view of a workpiece ground in the embodiments.
Figure 3B:
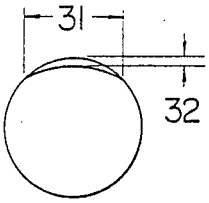
FIG. 3 illustrates a measured portion of a workpiece ground in the embodiments mentioned below.

In FIG. 3, 31 is the width of a ground surface and 32 the maximum ground reduction.

As is clear from TABLE 2, there is surprisingly a very distinct difference between the use of the prior art grinding tool (1) and the use of the grinding tool (2) of this invention in three runs for each of the workpieces. Since a ground curvature radius is nearer to the original curvature radius as the rate of change in curvature radius is smaller, it follows that the use of the ring grinding tool according to this invention affords satisfactory finish in grinding without any deformation of the original shape of workpiece.

TABLE 2

| | Ground Workpiece | | | | | |
|---|---|---|---|---|---|---|
| | Grinding Tool | | | | | |
| | (1) | | | (2) | | |
| Width of Ground Surface | 4.9 mm | 5 mm | 4.9 mm | 13 mm | 11.5 mm | 12 mm |
| Maximum Ground Reduction | 0.1 | 0.1 | 0.101 | 0.07 | 0.1 | 0.1 |
| Original Curvature Radius | 15 | 15 | 15 | 15 | 15 | 15 |
| Ground Curvature Radius | 29.64 | 28.52 | 29.93 | 15.67 | 16.33 | 16.19 |
| Rate of Change in Curvature Radius | 97.6% | 90.13% | 99.53% | 4.5% | 8.86% | 7.93% |
| Width of Ground Surface | 6.5 mm | 6.5 mm | 7.0 mm | 16.5 mm | 17 mm | 18 mm |
| Maximum Ground Reduction | 0.1 | 0.115 | 0.12 | 0.06 | 0.065 | 0.07 |
| Original Curvature Radius | 21 | 21 | 21 | 21 | 21 | 21 |
| Ground Curvature Radius | 34.59 | 38.34 | 35.34 | 21.47 | 21.72 | 21.68 |
| Rate of Change in Curvature Radius | 64.71% | 82.57% | 68.29% | 2.23% | 3.43% | 3.23% |
| Width of Ground surface | 9 mm | 8 mm | 8 mm | 26 mm | 26 mm | 26 mm |
| Maximum Ground Reduction | 0.04 | 0.04 | 0.05 | 0.02 | 0.015 | 0.015 |
| Original Curvature Radius | 50 | 50 | 50 | 50 | 50 | 50 |
| Ground Curvature Radius | 62.23 | 66.58 | 72.61 | 50.57 | 50.42 | 50.42 |
| Rate of Change in Curvature Radius | 24.46% | 33.16% | 45.22% | 1.14% | 0.84% | 0.84% |

What is claimed is:

1. A ring grinding tool suitable for use in grinding or polishing a workpiece, comprising a supporting rubber-made layer reinforced with a metal wire, having an inner surface for contacting a rotary member and having a thickness of 2 to 4 mm;

at least one porous elastic layer on the outside of said supporting layer and having a thickness of 8 to 10 mm, said porous elastic layer being made of natural rubber or styrene-butadiene rubber;

at least one elastic protective rubber sheet layer on the outside of said porous elastic layer and having a thickness of 0.8 to 1.0 mm, said rubber sheet being made of natural rubber or styrene-butadiene rubber; and a plurality of flat abrasive members secured to the outside of said elastic protective layer and spaced from each other to allow independent movement of the abrasive members, said protective rubber sheet layer conveying elastic force from said elastic layer to said abrasive members to allow said ring grinding tool to conform substantially to a curved surface of a workpiece.

2. The ring grinding tool according to claim 1, wherein the metal wire is a zinc bronze-plated music wire.

3. The ring grinding tool according to claim 1, wherein said metal wire has a diameter of 0.30 to 0.71 mm and is wound in the supporting layer at a pitch of 1.0 to 2.5 mm within a hatched area in the graph attached to FIG. 4.

* * * * *